United States Patent [19]

Bergman

[11] 4,322,022

[45] Mar. 30, 1982

[54] QUICK RELEASE FOR HELICALLY-THREADED DRIVE UNIT

[75] Inventor: Carl P. Bergman, Pompano Beach, Fla.

[73] Assignee: Whirlco, Inc., Pompano Beach, Fla.

[21] Appl. No.: 131,861

[22] Filed: Mar. 19, 1980

[51] Int. Cl.[3] ..... B67D 5/46

[52] U.S. Cl. ..... 222/327; 222/333; 222/390; 74/424.8 A

[58] Field of Search ..... 222/390, 333, 325–327; 74/424.8 A

[56] References Cited

U.S. PATENT DOCUMENTS

| | | | |
|---|---|---|---|
| 1,393,001 | 10/1921 | Wood | 222/390 X |
| 2,393,764 | 1/1946 | Frank | 74/724.8 A |
| 3,997,084 | 12/1976 | Davis, Jr. | 222/326 |
| 4,080,844 | 3/1978 | Killian | 74/424.8 A |
| 4,171,072 | 10/1979 | Davis, Jr. | 222/326 |

FOREIGN PATENT DOCUMENTS

| | | | |
|---|---|---|---|
| 80080 | 4/1934 | Sweden | 222/390 |

*Primary Examiner*—Charles A. Marmor

*Attorney, Agent, or Firm*—Cushman, Darby & Cushman

[57] ABSTRACT

The drive train of the threadably advanced piston for a power caulker is provided with a quick release feature. When this feature is activated, the active portions of the drive nut of a lead screw in the drive train are disconnected from the lead screw so that internal pressure in the supply chamber of the cartridge may quickly equilibrate itself by pushing the piston and its lead screw backwards. Thus, dispensing may be smartly stopped and sharply curtailed, merely by releasing the trigger on the power hand tool and activating the quick release. Either of these acts may be performed first or both may be performed simultaneously. By preference, the quick release feature includes threaded claws that are cammed into and out of driving relation with the lead screw by a simple twist of the drive nut.

4 Claims, 9 Drawing Figures

Fig. 5
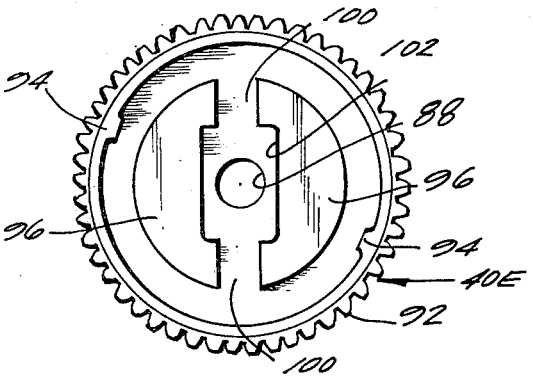
Fig. 6
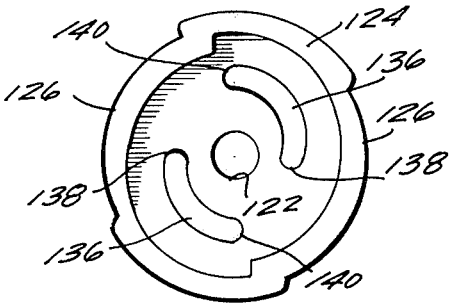
Fig. 7
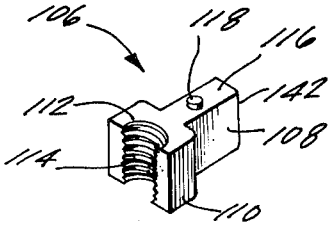
Fig. 8
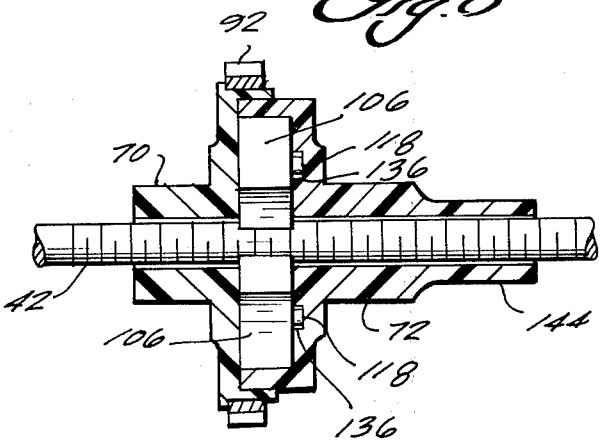
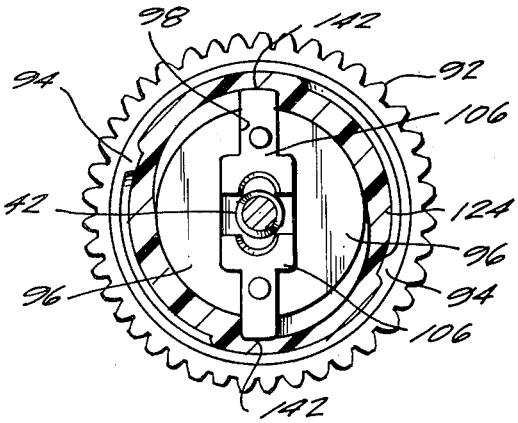
Fig. 9

QUICK RELEASE FOR HELICALLY-THREADED DRIVE UNIT

BACKGROUND OF THE INVENTION

In my copending U.S. patent application Ser. No. 15,304, filed Feb. 26, 1979 (as a continuation of Ser. No. 811,886, filed June 30, 1977, now abandoned), I have shown an adapter device for mating a caulking cartridge or the like with an electric drill or the like, so that while the trigger is squeezed on the resulting unit, caulking or the like will be dispensed in a continuous bead until either the trigger is released or the cartridge becomes empty. This adapter was designed particularly for use with electric drills which have a reverse mode. Accordingly, when dispensing is to be terminated and the cartridge is still partly full, in order to prevent unwanted continued extrusion of the plastic material from the cartridge spout, the user must momentarily switch the electric drill into its reverse mode. This results in backing-up of the cartridge piston, thus relieving internal pressure in the cartridge and terminating dispensing.

Such a device works well, but has somewhat limited appeal due to the fact that the most widely-used electric drills in the relevant market do not have a reverse mode.

Separate reversers are commercially available as adapters for such electric drills, but incorporation of one of these in the above-described unit, in which the electric drill, adapter and cartridge are all in one line tends to make the unit too long for some potential users to conveniently handle and operate.

It is also true that the adapter of Ser. No. 15,304 was designed to work with a cartridge of a non-standard type, e.g. not with the familiar push-in rear end wall piston-type cartridge of commerce, but with a twist top-type cartridge with an internal lead screw-mounted piston, e.g. of the type shown in my earlier U.S. Pat. No. 4,144,988, issued Mar. 20, 1979.

Although cartridges of the twist top variety have proved popular in the marketplace, because they may be used alone, i.e. without a caulking gun, I have become impressed with the fact that it would be wise to find a way to make the power caulker concept available for use by persons who would rather use it with the familiar push-in rear wall piston-type cartridge of commerce.

Accordingly, I made the invention now disclosed and claimed in my copending U.S. patent application Ser. No. 75,241, filed Sept. 14, 1979. The preferred unit described therein works with a standard caulking cartridge, incorporates a reverser unit for electric drills which have no built-in reverse mode, and has an S-shaped drive train so that the unit is not necessarily so long as the unit described in Ser. No. 15,304.

In any of these prior units, a reversal takes a finite time to let off pressure, so that a small, but unwanted amount of plastic material usually gets dispensed after the user wants to terminate the dispensing. In units where the electric drill has no built-in reverse mode, the provision of an add-on reverser is, I have come to believe, an unnecessarily slow and expensive way to accomplish the desired result.

Accordingly, I have developed the unit and components of the present invention.

SUMMARY OF THE INVENTION

The drive train of the threadably advanced piston for a power caulker is provided with a quick release feature. When this feature is activated, the active portions of the drive nut of a lead screw in the drive train are disconnected from the lead screw, so that internal pressure in the supply chamber of the cartridge may quickly equilibrate itself by pushing the piston and its lead screw backwards. Thus, dispensing may be smartly stopped and sharply curtailed, merely by releasing the trigger on the power hand tool and activating the quick release. Either of these acts may be performed first or both may be performed simultaneously. By preference, the quick release feature includes threaded claws that are cammed into and out of driving relation with the lead screw by a simple twist of the drive nut.

It is believed that most do-it-yourselfers, handymen and craftsmen when asked what an "electric drill" is will identify the expected familiar portable power-operated rotary chuck instrument, which has a motor that either has a power cable that can be plugged in to an electric power outlet, or is cordless and is served by rechargeable batteries mounted on the instrument. Obviously, it is a misnomer to call this instrument itself a "drill" since it is not constituted to function as a drill unless a drill bit is mounted in its chuck, and because the instrument may serve many other functions when other tools are mounted in its chuck, e.g. buffing, grinding, sanding, sawing, pumping and the like. In addition, instruments with similar utility but which have fluid-powered motors exist in the prior art, even though among the general populace they are less well known. Such devices may have air motors or hydraulic motors. Where such a device is intended to serve a single purpose a chuck per se may be unnecessary, and a single purpose tool, tool holder or the like directly connected at the output end of the drive train of the device. In order to avoid giving too restrictive an impression herein, since the invention is applicable to this whole class of devices, the generic referent "hand-held, powered rotary output device" is used.

While it is true that the present inventor developed the present invention in order to provide a quick, inexpensive pressure release for the cartridge of a power caulker, it is also true that the present inventor recognizes that he has invented a clutch for the drive nut of a lead screw, whether this sub-system is used in a power caulker or elsewhere.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWINGS

In the Drawings

FIGS. 4–7 are various views of individual pieces of the drive nut of FIG. 3.

FIG. 8 is a fragmentary longitudinal sectional view of the drive nut/lead screw assembly with the lead screw engaged; and FIG. 9 is a transverse cross-sectional view of the drive nut/lead screw with the quick release feature actuated to declutch the threaded claws of the drive nut from the lead screw.

DETAILED DESCRIPTION

Figure 1:
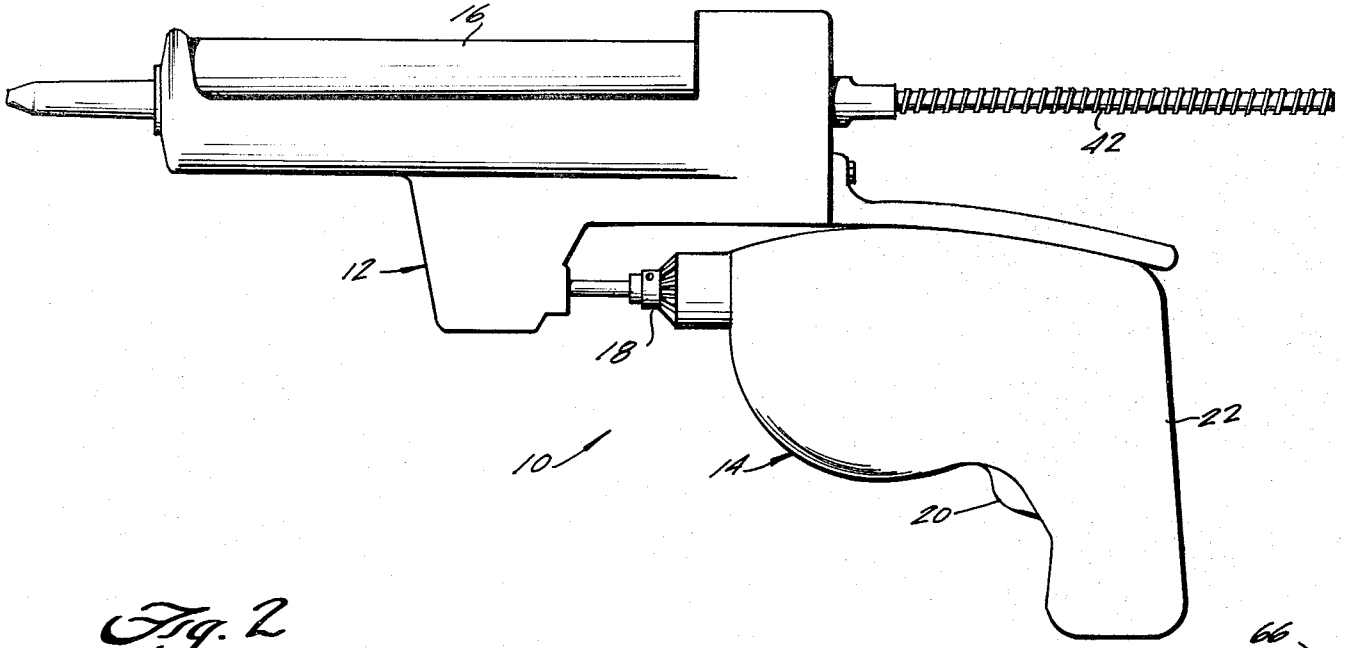
FIG. 1 is a side elevation view of a power caulker unit provided with a quick release feature in accordance with the present invention.

As in Ser. No. 75,241, the unit 10 includes an adapter 12 which mates a hand-held, powered rotary output device 14 with a caulking cartridge 16.

In the instance depicted, the device 14 is a conventional cordless electric drill, with a rotary chuck 18 at the output end of its internal drive train. Accordingly, the chuck 18 rotates for so long as the trigger 20 is squeezed, and comes to rest when the trigger 20 is released.

To the housing 22 of the device 14, there is shown secured as at 24 the housing 26 of the adapter 12. This is for convenience; the two housings 22, 26 could be more fully integrated into one if desired. Usually the housing 26 would be molded of two or more complementary parts, e.g. a left half and a right half, with means provided (not shown) for securing these parts together.

Basically, the housing 26 includes a first portion 28 for housing a drive train 30 and a second portion which functions as a receiver 32 for the usually expendable/replaceable caulking cartridge 16.

The caulking cartridge 16 shown is an utterly conventional one. It has a front end wall 46 with a centrally, forwardly projecting hollow spout 47, the initially closed tip 48 of which gets snipped-off by the user when dispensing from a new cartridge is about to be begun. Extending rearwards from the front end wall is a tubular sidewall 50, which provides an internal chamber 52 which initially is filled with a plastic compound 54 and is closed at the rear by a slidingly fitted, e.g. piston-like end wall 56. By "plastic" I mean to refer to a flow characteristic and not merely to a particular class of polymeric chemicals. Thus, the term "caulking" is loosely-used herein to generally refer to such broadly plastic compounds and mixtures as all those normally found in such or in a similar container in the caulking, painting, adhesive, sealant, etc. display racks of large hardware, builders', craftsmens' and hobbiests' supply stores, and for other products one might not think of at first—e.g. medicaments, foodstuffs, cosmetics and the like.

Accordingly, if the tip 48 is snipped-off and external pressure is applied to the end wall piston 56 in a sense to push the latter forwards, the chamber 52 tends to decrease in internal volume and increase in internal pressure. This causes the plastic material 54 to ooze in a bead from the spout 47. If pressure is continually applied to drive the end wall piston 56 forwardly, a steady state condition is achieved wherein the outflowing bead of plastic material is a continuous line. If the externally applied pressure is terminated, but the means which applied the pressure is left in immobile engagement with the end wall piston 56, the steady state condition will decay over a finite period of several seconds or minutes, during which plastic material will continue to ooze from the spout 47 at an ever-declining rate until the pressure, viscosity and frictional forces within the chamber are equalized with the atmospheric pressure in the environment of the cartridge.

The fundamental reason the present invention was developed is to substantially steepen said decay rate.

Figure 2:
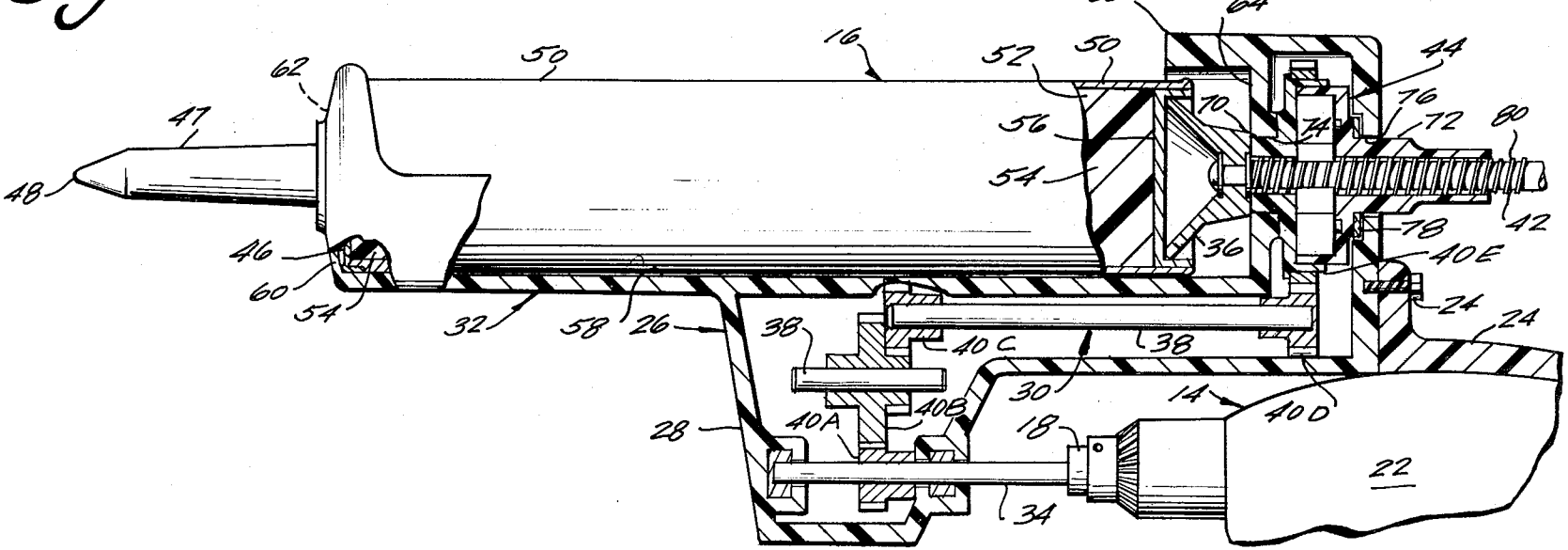
FIG. 2 is a larger scale fragment of what is shown in FIG. 1, with some parts broken away and sectioned to expose interior detail.

Typically, the receiver 32 is an upwardly open cradle 58 with a front end wall 60 that has an upwardly-open U-shaped notch 62 sized, shaped and positioned to cradle the base of the caulking cartridge spout. The interior of the cradle 58, from its front end wall 62 to its rear end wall 64 is slightly longer than the cylindrical sidewall of the cartridge, but the cradle 58 preferably has a forwardly projecting overhanging flange 66 on the front of the rear end wall 64 so that it is necessary to use a two-step procedure to install a new cartridge. First, the rear end of the cartridge is inserted into the cradle and moved back under the ledge 66 and towards the rear end wall 64. Then the front end of the cartridge is lowered until the base of the spout 47 comes to rest in the U-shaped notch 62 of the front end wall of the receiver. This permits easy installation and removal of the cartridge while guarding against jackknifing of the cartridge out of the receiver during use. The drive train 30 preferably is generally "S"-shaped, (actually backwards "S"-shaped looking in the FIGS. 1 and 2 direction). In general, between the horizontally axially rearwardly projecting input shaft 34, shown projecting out of the rear of the housing 26 and the horizontally axially forwardly projecting plunger 36, the drive train has a number of thrust and sleeve bearing-journalled shafts 38 with respective meshing gears 40A, 40B, 40C, 40D and 40E mounted thereon, and a lead screw 42 in driven relation with a drive nut 44 that is associated with the last of the aforementioned gears. In FIG. 2, most of the bearings, except those for the input shaft 34 and drive nut 44/gear 40E are omitted for simplicity, since the ones shown typify the omitted ones.)

Thus, whereas the gears 40A, 40B and 40C are located under the receiver about half way along its length, the gear 40E is located directly behind the receiver rear end wall 64 in coaxial alignment with the cartridge.

The housing 26 of the adapter 12 is shown completely enclosing the shafts and gearing except for where the input shaft possibly protrudes out for mounting in the chuck and for where tubular hub bosses 70, 72 of the drive nut 44 are journalled respectively in a first opening 74 in the rear end wall 64 of the receiver and in a second opening 76 in a wall 28 located coaxially behind the first. A washer-like thrust bearing 78 is shown provided for the drive nut; it is located in a correspondingly-shaped recess perimetrically of the opening 76.

Normally when the device is being used to dispense a bead of plastic material, the drive nut is in threaded engagement with the helical threads 80 on the lead screw 42 which passes coaxially through the tubular hub bosses 70, 72 of the drive nut.

The plunger 36 that is mounted on the forward end of the lead screw is sized, shaped and positioned to be run into engagement with the rear end wall piston of the cartridge and to be the instrumentality by which external pressure is applied to that cartridge piston to drive it forwardly for dispensing a bead of cartridge contents from the cartridge spout.

The drive nut 44 is a multi-component composite member, the structure and cooperation of which is best understood by reference to all the drawing Figures, and especially to FIGS. 3–8.

The drive nut 44 includes two main portions 82, 84 which are integrally formed with the respective hubs 70, 72.

The drive nut portion 82 includes a disk-shaped end wall 86 on the axially inner side of which the hub 70 is formed as a boss. A bore 88 is formed coaxially through the wall 86 and hub 70. At or near its radially outer periphery, the end wall 86 is provided with a circumferential skirt flange 90 which projects axially rearwardly. The radially outer side of the flange 90 is provided with a ring of gear teeth 92. Although the gear ring 92 in the drive train 30 is shown being a separately formed element that is mounted on the flange 90, it could be integrally formed with the flange 90.

The radially inner side of the flange 90 is shown provided with two diametrically opposed, radially inwardly projecting stop keys 94.

At a location that is radially intermediate the flange 90 and the bore 88, the axially outer face of the end wall 86 is provided with two laterally spaced generally D-shaped bosses 96 which together constitute claw mount means. The lateral spacing between the bosses 96 provides a slot 98 which has two relatively narrow terminal portions 100 and a broader central portion 102.

The D-shaped bosses 96 are spaced sufficiently radially inwardly of the flange 90 that there is provided a circumferentially extending annular slot 104 radially intermediate the flange 90 and the claw mount bosses 96.

Figure 3:
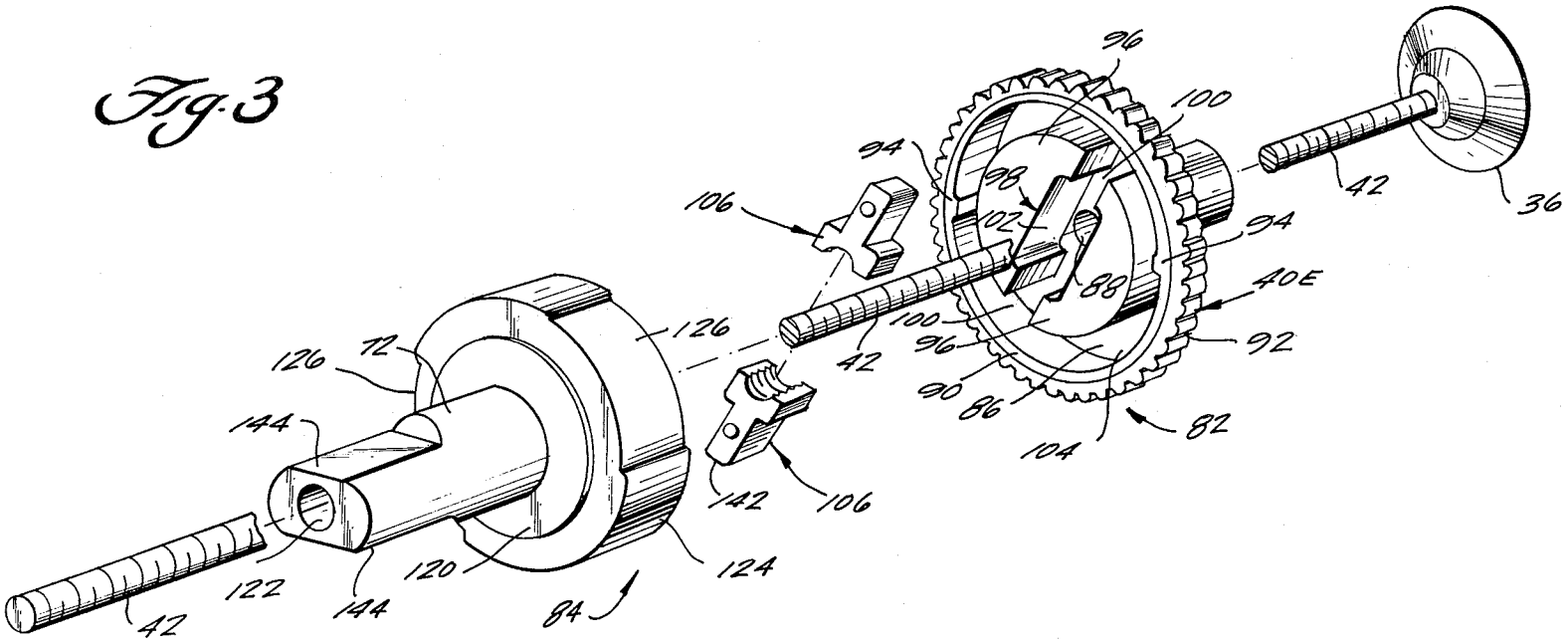
FIG. 3 is an exploded perspective view of the lead screw and the drive nut incorporating the quick release feature.
Figure 4:
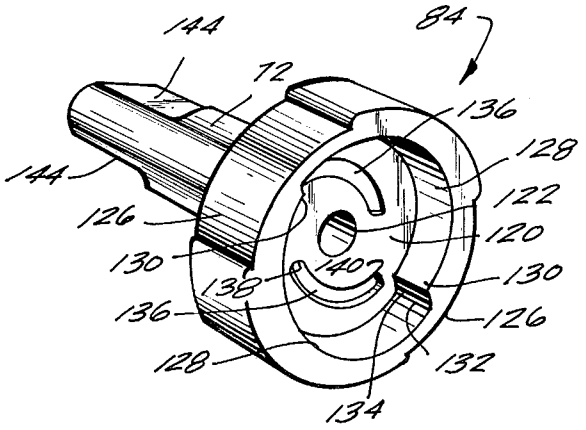

One claw 106 is shown by itself in FIG. 7; both of them (which are mirror images) are shown in FIG. 3. Each is a generally T-shaped element having a radially outer center leg 108 topped by a cross head 110 the radially inner end of which is provided with a cylindrically concave furrow 112 bearing part-helical internal threading arcs 114, or the like. The axially outer face 116 of each claw leg 108 is shown provided with an integral, axially extending cam follower pin boss 118.

Except for the bosses 118, the claws 106 are as axially thick as the D-shaped bosses 96 and the terminal portions 100 of the slot 98 are just wide enough to slidingly receive the center legs 108 when the claw heads 110 are slidingly received in the broader central portion 102 of the slot 98.

The second main portion 84 of the drive nut includes a disk-shaped end wall 120 on the axially outer side of which the hub 72 is formed as a boss. A bore 122 is formed coaxially through the wall 120 and hub 72. At or near its radially outer periphery, the end wall 120 is provided with a circumferential skirt flange 124 which projects axially forwardly. The radially outer side of the flange 124 is provided with two diametrically spaced keyway recesses 126, each of about one-fourth of the circumference in angular extent.

The radially inner side of the flange 124 is provided with two diametrically opposed, half-turn spiral cam surfaces 128 of the same angular hand, so that each is radially highest at 130 and radially lowest at 132, there being a respective stop surface 134 between the high point of one cam and the low point of its neighbor.

The end wall 120, on its axially inner side is provided at two radially intermediate sites with respective arcuate cam grooves 136. The grooves 136 are generally radially inwardly concave from end to end, but each is eccentrically disposed so that the relatively clockwise ends 138 of each (as viewed in FIG. 4) are radially closer to the central bore 122 than are the relatively counterclockwise ends 140 of each.

When the two main portions of the drive nut are slid axially together, with the claws 106 already in place, the skirt flange 124 slides into the circumferential slot 104. Accordingly, the radially outer ends 142 of the two claw legs ride against the respective spiral cam surfaces 128 and the cam follower pin bosses 118 ride in the respective arcuate cam grooves 136.

The axle boss 72 is relatively long so that a rear end portion is available outside the housing 22. The exposed projecting portion of the boss 72 is preferably provided with a knurled, recessed or otherwise suitably hand gripped region 144 which is conveniently available to be twisted.

As should be easy to understand, upon manually twisting the boss 72 back and forth 90 degrees, the cams just explained cause the claws to slide radially in and out relative to the lead screw 42 between the inner, engaged situation shown in FIG. 8 and the outer, disengaged situation shown in FIG. 9. (The bores through the hub bosses 70, 72 are otherwise oversize with respect to the lead screw threading 80.)

Thus, for normal use, the boss 72 is manually turned to provide the FIG. 8, "in-gear" relationship, in which depressing of the trigger 20 will cause the lead screw to rotate and push the plunger 36 forwards, thus pressing the piston-like rear end wall 56 of the cartridge forwards to dispense a continuous bead of plastic product from the cartridge spout.

When the user wants to discontinue dispensing and to take the pressure off the remaining cartridge contents so they will not continue to ooze out of the spout tip, the user merely releases the trigger 20 and manually rotates the boss 72 arcuately about ninety degrees to provide the FIG. 9, "out-of-gear" relationship. Accordingly, the lead screw 42 will jump back a little bit, immediately taking the pressure off the cartridge contents and terminating both the dispensing and the oozing.

It should now be apparent that the quick release for helically-threaded drive unit as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A quick release for a helically-threaded drive unit, comprising:

a helically-threaded lead screw means;

drive train means for driving said lead screw means;

said drive train means including a drive nut mounted on said lead screw means and means for rotating said drive nut;

said drive nut being an assemblage of a plurality of parts including claw means and means for moving said claw means into and out of driving engagement with the helical threading of said lead screw means, said moving means being capable of moving said claw means between an in-gear disposition in which rotation of said drive nut necessarily causes driving of said lead screw means and an out-of-gear disposition in which said lead screw means is axially slidable relative to said drive nut;

a housing means for said drive train means, said housing means including a cradle sized to receive a replaceable cartridge of plastic material of the type which has a front end spout and a piston-like rear end wall;

said lead screw means having a forward end including a plunger disposed in said cradle for forwardly pressing engagement with the piston-like rear end wall of the cartridge;

among said plurality of parts said drive nut including two major portions which enclose said claw means between them, said means for moving said claw means into and out of driving engagement with the helical threading of said lead screw means comprising cam and cam follower means on said two major portions and on said claw means, which, upon part-circumferential reversible rotation of one of said major portions relative to the other of said major portions moves said claw means between said in-gear disposition and said out-of-gear disposition;

one of said major portions including a hub which extends out of said housing means, and outside of said housing means is provided with a hand grip wherewith said hub may be reversibly twisted to provide said part-circumferential reversible rotation;

means defining an axially rearwardly opening diametric slot on the other of said major portions, said claw means being slidingly received in said slot for radially inward/radially outward sliding therein;

said cam and cam follower means including:

axially forwardly presented spiral cam surface means extending part-circumferentially on said one major portion;

axially rearwardly presented cam follower means on said claw means;

said cam follower means being engaged with said spiral cam surface means;

means defining an axially rearwardly projecting circumferential flange on said other major portion, this flange being spaced radially outwardly of said diametric slot-defining means, thereby defining an axially rearwardly opening circumferential slot on said other major portion, this rearwardly opening slot surrounding said diametric slot;

stop key means projecting on said other major portion, into said rearwardly opening circumferential slot;

means defining an axially forwardly projecting circumferential flange on said one major portion, this flange being spaced radially outwardly of said spiral cam surface means and being coaxially rotatably received in said axially rearwardly opening circumferential slot on said other major portion;

means defining at least one part-circumferentially extending, radially facing keyway on said axially forwardly projecting circumferential flange;

said stop key means being received in said keyway, and said keyway having surface means at angularly opposite ends thereof which are arranged to be engaged by said stop key means upon such extensive relative angular movement of said two major portions of said drive nut that, as to such extensive movement in one angular sense said claw means is fully in said in-gear disposition and as to such extensive movement in the opposite angular sense said claw means is fully in said out-of-gear disposition;

said axially forwardly projecting circumferential flange on said one major portion of said drive nut further including at least one part-circumferentially extending, radially inwardly facing spiral cam surface means thereon having angularly presented stop means at a respective end of greatest radial extent thereof, this spiral cam surface means but for the angularly presented stop means being arranged for sliding contact with radially outer end surface means on said claw means, and said angularly presented stop means being arranged to engage said claw means upon said such extensive relative angular movement of said two major portions of said drive nut in said opposite angular sense;

said drive train including a ring of gear teeth circumferentially provided on said axially rearwardly projecting circumferential flange on said other major portion of said drive nut.

2. The quick release of claim 1, further including:

a hand-held powered rotary output device chucked to said drive train means as input rotary power for said drive train means.

3. The quick release of claim 2, wherein:

said drive train means comprises a train of shafts and meshing gears which starts with a generally rearwardly protruding exposed shaft stub, proceeds in a reverse S-shape and ends with said plunger, which is forwardly presented, so that said housing means partially surmounts said hand held powered rotary output device.

4. The quick release of claim 3, wherein:

said hand-held powered rotary output device is constituted by a cordless electric drill.

* * * * *